US005730234A

United States Patent [19]

Putot

[11] Patent Number: 5,730,234

[45] Date of Patent: Mar. 24, 1998

[54] METHOD FOR DETERMINING DRILLING CONDITIONS COMPRISING A DRILLING MODEL

[75] Inventor: Claude Putot, L'Etang la Ville, France

[73] Assignee: Institut Francais du Petrole, Rueil Malmaison, France

[21] Appl. No.: 645,569

[22] Filed: May 14, 1996

[30] Foreign Application Priority Data

May 15, 1995 [FR] France ..... 95 05825

[51] Int. Cl.[6] ..... E21B 47/00; E21B 49/00

[52] U.S. Cl. ..... 175/50; 175/57; 73/152.01; 73/152.43

[58] Field of Search ..... 175/46, 50, 45, 175/40, 48; 73/152.01, 152.43

[56] References Cited

U.S. PATENT DOCUMENTS

| | | | |
|---|---|---|---|
| 4,195,699 | 4/1980 | Rogers et al. | 175/27 |
| 4,599,904 | 7/1986 | Fontenot | 73/783 |
| 4,695,957 | 9/1987 | Peltier | 73/152.48 X |
| 4,759,214 | 7/1988 | Sekine et al. | 73/152.11 |
| 4,959,164 | 9/1990 | Engelmann et al. | 507/136 |
| 4,972,703 | 11/1990 | Ho | 175/45 X |
| 5,196,401 | 3/1993 | Engelmann et al. | 507/120 |
| 5,456,141 | 10/1995 | Ho | 76/108.2 |

FOREIGN PATENT DOCUMENTS

| | | |
|---|---|---|
| 0 466 255 | 1/1992 | European Pat. Off. . |
| 0 551 134 | 7/1993 | European Pat. Off. . |

OTHER PUBLICATIONS

I.E. Eronini et al., "A Dynamic Model for Rotary Rock Drilling", *J. of Energy Resources Technology*, vol. 104(1):108–120, 1982.

I.J. Jordaan et al., "The Crushing and Clearing of Ice in Fast Spherical Indentation Tests", *OMAE 1988 Houston: Proceedings of the Seventh Intl . . .*, vol. IV:111–117, 1988.

E.E. Andersen et al., "PDC Bit Performance Under Simulated Borehole . . . ", *Soc. of Petroleum Engineers*, SPE 20412:77–87, 1990.

E. Kuru et al., "A Method for Detecting In–Situ PDC Bit Dull and . . . ", *IADC/Soc. of Petroleum Engineers*, IADC/SPE 17192:137–152, 1988.

C.A. Cheatham et al., "Bit Balling in Water–Reactive Shale During . . . ", *IADC/Soc. of Petroleum Engineers*, IADC/SPE 19926:169–178, 1990.

A.J. Garnier et al., "Phenomena Affecting Drilling Rates at Depth", *Soc. of Petroleum Engineers of AIME*, Paper No. 1097–G:1–7, 1958.

*Primary Examiner*—Frank Tsay

*Attorney, Agent, or Firm*—Millen, White, Zelano & Branigan, P.C.

[57] ABSTRACT

A method for the improvement of performances involves a drilling model wherein the model takes account of the effects of the destruction of a rock (2) by a cutter (1) fastened to a bit body (3) driven in rotation and the effects of the removal of rock cuttings by a fluid, by calculating a material balance from the production of cuttings by the cutter that has penetrated the rock by a depth δ, a bed of cutting of thickness l, a fluid strip of thickness h between the bed of cuttings and body (3), the fluid strip having a cuttings concentration c.

16 Claims, 1 Drawing Sheet

METHOD FOR DETERMINING DRILLING CONDITIONS COMPRISING A DRILLING MODEL

FIELD OF THE INVENTION

The present invention relates to a method for determining the drilling conditions of a drill bit comprising several cutters interacting with a rock. The method comprises using a drilling model based on the coupling of the effects of the destruction of the rock by the cutters and the effects of the removal of cuttings by a fluid. The invention preferably applies to the study of the balling of a PDC type bit. Balling is a dysfunctioning that is frequently observed by drill men, which is very harmful since it can decrease the drilling rate in considerable proportions and sometimes even irreversibly annihilate the drilling effects in certain formations.

Several works have already been published, but none takes account of the discharge of material as the modelled representation in the present method. The main works are cited in the list of references included hereafter.

SUMMARY OF THE INVENTION

The present invention thus relates to a method allowing to improve drilling performances in which a drilling model is used. The model takes account of the effects of the destruction of a rock by at least one cutter fastened to a bit body driven in rotation and the effects of the removal of the cuttings by a fluid, by calculating a material balance from:

- the production of cuttings by the cutter that has penetrated the rock by a depth $\delta$,
- a bed of cuttings covering the rock of thickness l,
- a fluid strip of thickness h between the bed of cuttings and the body, the fluid strip having a cuttings concentration c,
- control parameters,
- environment parameters.

The method allows to determine the drilling conditions as a function of the response of the model for predetermined values of said parameters.

At least one of said parameters: weight on bit, bit speed and fluid flow rate, can be a control parameter.

In the model, the lift W of the bit can be split up into a solid component Ws and a hydraulic component Wh depending notably on the fluid strip.

One can consider a wide grain-size range of the cuttings distributed according to a normal law dependent on the depth of cut $\delta$, of average $\mu$ linked with the ductility of the rock and of a dispersion characterized by the standard deviation $\sigma$.

The solid material balance B(t) can be such that $B(t)=B^{+}(t)-B^{-}(t)$, where $B^{+}(t)$ is a cuttings production term dependent on $\delta$ and corresponding to the rate of destruction of the rock, and $B^{-}(t)$ is an expulsion term dependent on l and h.

Drilling can be represented as a dynamic system comprising, in the conventional internal representation by state variables x, inputs u that are those of a control system "weight on bit", rotary speed of the rods, hydraulic power, a system that is also subject to uncontrollable disturbances v associated with the variability of the properties of the rocks. With the present model, the system is observed by means of the output variables y that can be, among other things, the torque at the level of the bit, the rate of penetration in the axis of the hole, indicators linked with the vibration level such as the widening of the hole diameter, indicators of the wear of the drilling head cutters, that are unfortunately difficult to design, and all of these output variables can be disturbed by a noise w.

Drilling optimization can thus consist in seeking a control strategy allowing the drill man:

- to avoid risks relative to localized hazards, for example linked with very hard rock bands or, at the opposite extreme, likely to lead to the balling of the bit;
- to have a coherent strategy fitted to the drilling operation: for example, determination of the optimal number and period of service of the drill bits, or the necessity of adjusting the drilling operation as the cutters wear out.

It is also clear that the present method can help determine the structure of the drill bits: for example, shape and positioning of the cutters, determination of the hydraulic flows in the neighbourhood of the destruction of the rock.

BACKGROUND OF THE INVENTION

The following references can serve as an illustration of the technological background of the field concerned, as well as complements to the description of the present invention.

Andersen E. E. and Azar J. J., 1990, "PDC performance under simulated borehole conditions" SPE 20412, New Orleans, September 1990.

Cheatham C. A. and Nahm J. J., 1990, "Bit balling in water-reactive shale during full-scale drilling rate tests" IADC/SPE No. 19926, Houston.

Déliac E. P., 1986, "Optimisation des machines d'abattage á pic" Doctoral dissertation, U. Paris 6, ed. by ENSPM/CGES France.

Detournay E. and Atkinson C., 1991, "Influence of pore pressure on the drilling response of PDC bits", Rock Mechanics as a Multidisciplinary Science, Roegiers (ed.), Rotterdam.

Detoumay E. and Defoumy P., 1992, "A Phenomenological Model for the Drilling Action of Drag Bits", Int. J. Rock Mech. Min. Sci. & Geomech. Abstr. Vol. 29, No. 1, p. 13–23.

Falconer I. G., Burgess T. M and Sheppard M. C., 1988, "Separating Bit and Lithology Effects from Drilling, Mechanics Data", IADC/SPE Drilling Conference, Dallas, Feb.28–Mar. 2, 1988.

Gamier A. J. and van Lingen N. H., 1958, "Phenomena affecting drilling rates at depth" SPE fall meeting, Houston.

Glowka D. A., 1985, "Implications of Thermal Wear Phenomena for PDC Bit Design and Operation", 60th Annual Technical Conference and Exhibition of the Society of Petroleum Engineers in Las Vegas, Sep. 22–25, 1985, SPE 14222.

Karasawa H. and Misawa S., 1992, "Development of New PDC Bits for Drilling of Geothermal Wells—Part 1: Laboratory Testing", Journal of Energy Resources Technology, December 1992, vol. 114, p.323.

Pessier R. C. and Fear M. J., 1992, "Quantifying common drilling problems with mechanical specific energy and a bit specific coefficient of sliding friction" SPE 24584.

Pessier R. C., Fear M. J. and Wells M. R., 1994, "Different shales dictate fundamentally different strategies in hydraulics, bit selection and operating practices".

Pierry J. and Charlier R., 1994, "Finite element modelling of shear band localization and application to rock cutting by a PDC tool" SPE/ISRM Eurock Conference, Delft.

Putot C., 1995, "Un modèle de foration prenant en compte les effets de destruction de la roche et d'évacuation des déblais", 2e Colloque national en calcul des structures, Giens.

Sellami H., 1987, "Etude des pies usés, application aux machines d'abattage" Doctoral Dissertation ENSMP/CGES France.

Sellami H., Fairhurst C, Déliac E. and Delbast B., 1989, "The Role of in-situ Stresses and Mud Pressure on the Penetration of PDC bits" Rock at Great Depth, Maury & Fourmaintreaux eds, Rotterdam 1989.

Sinor A. and Warren T. M., 1989, "Drag Bit Wear Model", SPE Drilling Engineering, June 1989, p. 128.

Sinor A., Warren T. M., Behr S. M., Wells M. R. and Powers J. R., 1992, "Development of an anti-whirl core bit", SPE 24587.

Wardlaw H. W. R., 1971, "Optimization of Rotary Drilling Parameters" PHD Dissertation, U. of Texas.

Warren T. M. and Winters W. J., 1986, "Laboratory Study of Diamond-Bit Hydraulic Lift", SPE Drilling Engineering, August 1986.

Warren T. M., 1987, "Penetration-Rate Performance of Roller-Cone Bits", SPE Drilling Engineering, March 1987.

Warren T. M. and Armagost W. K., "Laboratory drilling performance of PDC bits", SPE Drilling Engineering, June 1989.

Warren T. M. and Sinor A., "Drag-bit performance modeling", SPE Drilling Engineering June 1989.

Wells R., "Dynamics of rock-chip removal by turbulent jetting", SPE Drilling Engineering, June 1989.

Zijsling D. H., "Single cutter testing: a key for PDC bit development", SPE 16529 Offshore Europe Aberdeen, 1987.

BRIEF DESCRIPTION OF THE DRAWINGS

Other features and advantages of the present invention will be clear from reading the description hereafter, with reference to the accompanying drawings in which.

DESCRIPTION OF THE METHOD

The model presented hereafter is a non linear evolution model with, in a first variant, three independent variables assumed to characterize completely the state of the drilling system. It is actually a so-called "local" cutter model whose functioning is sufficient to describe, in this variant, an average of the global behaviour of the drill bit.

Figure 1A:
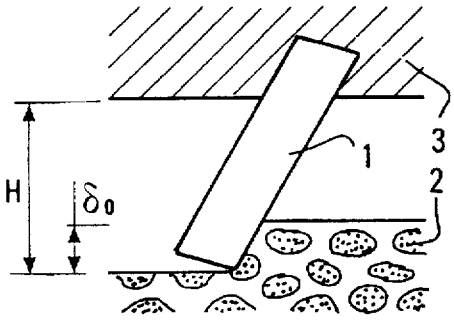
FIGS. 1A and 1B show the physical model under initial conditions and in thee process of evolution at the time t.
Figure 1B:
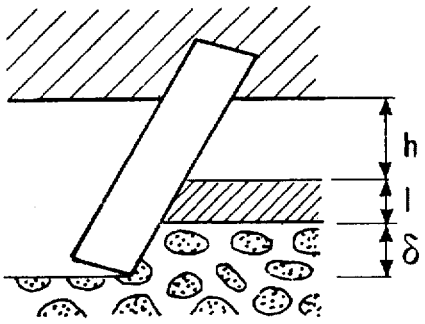

FIG. 1B shows the interaction of the cutter with the virgin rock 2 and the present penetration $\delta$ constitutes a first state variable. FIG. 1A shows the initial conditions where the cutter of height H, fastened to a body 3, has penetrated the rock by the depth $\delta_o$. Besides, specific studies are conducted on the cutting process, which show the variety and the difficulty in taking account of the modes of representation: more or less guaranteed independence of the cutting and the thrust load effects, not necessarily one-to-one link between penetration and normal stress, justified by the plasticity theory, influence of successive retreatments (work is hardening).

The hypothesis chosen in this work consists merely of a one-to-one link between normal stress exerted on the cutter and penetration. Let $W_s$ be the so-called "solid" vertical stress associated with this penetration. The link between $W_s$ and $\delta$ will be explained hereafter.

Each of the $N_C$ equivalent cutters forming the bit produces rock chips and this instantaneous production, assumed to be proportional to $\delta$, is partly evacuated in the annular space, partly stored in the immediate neighbourhood of the cutter in the form of a bed of cuttings whose present thickness is the second state variable of our formulation, denoted l; this bed of cuttings is assumed to cover uniformly the rock front.

The residual space between the bit body and the bed of cuttings allows the rock chips to be removed. This removal is difficult when the residual space is limited; the thickness of the fluid strip, denoted h, is of course connected to the overall height H of the cutter in new condition by the relation:

$$H=h+\delta+l+y$$

where $\gamma$ is the worn blade height, a slowly evolutionary quantity that is actually considered to be a parameter. Removal is also hindered when the equivalent viscosity of the suspension is increased because of the increase in the solid particles concentration. These two effects are expressed by the relation as follows:

$$W_H=\frac{N\delta\eta D_B^4}{h^3}$$

The article by Jordaan I. J., Maes M. A. and J. P. Nadreau, 1988, "The crushing and clearing of ice in fast spherical indentation tests", Offshore Mechanics and Arctic Engineering, Houston, can be consulted.

The third state variable is also naturally introduced: it can be the concentration c of the suspension, but one will rather select the associated "equivalent" dynamic viscosity $\eta$ or the equivalent kinematic viscosity $\upsilon$ (to be distinguished from the viscosity $\upsilon_o$ of the fluid proper).

As mentioned above, the control quantities defined are the quantities for which an intervention is possible or desirable, mainly:

the weight on bit W the rotary speed N the fluid flow rate or the hydraulic power; in fact, in the present model, the rate of flow $\upsilon_n$ at the nozzle outlet.

In the present example, these quantities are assumed to be constant and therefore comparable to the numerous parameters of the problem. The response of the system to a disturbance of this control parameter can nevertheless be contemplated and various types of regulation associated with the variability of the properties of the rocks can be considered.

In the present model, the analysis of the splitting up of the weight on bit is based on the principle of separation between a so-called solid conventional component $W_S$ for which usual representation formulas are indicated, and a hydraulic lift $W_H$ that increases considerably when the thickness h of the fluid strip decreases and the equivalent viscosity $\eta$ increases; we have:

$$W=W_S+W_H.$$

The solid component $W_S$ is formulated according to the article by Kuru E. and Wojtanowsicz A. K., 1988, "A Method for Detecting In-Situ PDC Dull and Lithology Change", IADC/SPE Drilling Conference, Dallas, Feb.28–Mar. 2 1988.

$A_\gamma$ thrust area of each cutter at the stage of wear $\gamma$ $A_c(\delta)$ the cutting area when the wear is $\delta$, the solid penetration $\delta$ $S_p$ and $S_c$ the strengths of the rock, respectively the compression and the shear strength $N_c$ number of cutters $D_B$ diameter of the bit $\alpha$ and $\mu^+$ characteristics linked with the bit/rock interface.

We have;

$$\frac{W_S}{N_c A_\gamma} = S_p + \frac{A_c(\delta)}{A_\gamma} S_c(\sin\alpha + \mu^+\cos\alpha)$$

The hydraulic component is formulated according to the article by Jordaan I. J., Maes M. A. and J. P. Nadreau, 1988, "The crushing and clearing of ice in fast spherical indentation tests", Offshore Mechanics and Arctic Engineering, Houston.

$$W_H = \frac{N\delta\eta D_B^4}{h^3}$$

$\eta$ equivalent (dynamic) viscosity of the mud plus solid particles suspension.

The impeded circulation of the (particle-enriched) drilling fluid and notably the pressure loss at the edge of the bit are indicators of this lift effect.

The present invention also describes a rock fracture model integrated in the drilling model.

It is a representation model with an idealized diagram of a parallelepipedic chip of thickness $\delta$ and of square area, of side $mD_c$, where $D_c$, is the hydraulic diameter considered for the removal. Despite the simplicity of this geometry, one considers that it is important to take account era wide grain-size range.

A Gaussian distribution of sizes $D_c$ is thus considered, which takes account of:

the present depth of cut $\delta$ the ductility of the rock expressed through parameter $\mu = E(D_c)/\delta$ a dispersion characterized by the standard deviation $\sigma$.

$E(D_c)$ expresses the average of the size distribution and $\mu$ denotes the degree of ductility of the rock broken under the drilling conditions, a characteristic assumed to be independent of $\delta$; $m \geqq 1$ is a parameter relating the hydraulic diameter to the geometry; m is often assumed to be m=1.

Rather than the variable $D_c$, the number n of chips removed by each of the $N_c$ cutters of a bit of diameter $D_B$ during one revolution is preferably introduced, so that:

$$n = \frac{\pi}{4m^2 N_c}\left[\frac{D_B}{D_c}\right]^2$$

In the article "A Dynamic Model for Rotary Rock Drilling", Journal of Energy Resources Technology, June 1982, vol. 104, p. 108, by authors Ronini I. E., Somerton W. H. and Auslander D. M., 1982, a chip removal model that is reproduced here with introduction of a wide grain-size range is considered for a tricone bit.

The expression of the hydrodynamic stresses exerted on the rock chip delimited by the fracture, used in the present model, is also described in the above-mentioned article.

The foundations of the model are as follows:

The retention effect due to the pressure difference between the mud pressure and the pore pressure, whose effect is considerable in relation to the effect of gravity, first has to be overcome in order to detach the chip. The associated stress is assumed to be overcome by the lift effect alone $F_L$ (L=lift) whose expression is presented in Appendix 1. The time constant $\tau_L$ of the process is extremely short and therefore disregarded in relation to that associated with the drag effect proper ($F_D$ and $\tau_D$; D=drag). The chip is then accelerated from the position where it has conceptually come out of its housing under the effect of the drag stress $F_D$ up to the annular space.

Let $\omega_o$ be the own weight of the rock chip of usual size $D_c$ and $\omega_c$ the sucking force exerted on this fragment in order to retain it; the removal condition is expressed as follows:

$$\frac{F_L}{\omega_o} \geqq \frac{\omega_c}{\omega_o}$$

with a representation model of $\omega_c$ by Eronini (1982), the detail of which is not given here, condensed thanks to parameter $\lambda$, as a function notably of the presence of a cake whose permeability is assumed to be known.

$$\frac{F_L}{\omega_o} \geqq 1 + \frac{\lambda P}{\delta\rho_c g}$$

$\rho_c$ density of the solid particles.

In practice, the term 1 is quite negligible in relation to the second.

Only the particles characterized by $D_c \leqq D_c^o$ are expelled, where $D_c^o$ is the chip size achieving exactly equilibrium between sucking force and lift effect:

$$\frac{F_L}{\omega_o} = \frac{\omega_c}{\omega_o}$$

The position of $D_c^o$ with respect to the grading curve conditions the proportion of particles "removed" in relation to those "produced".

Assume the distributions to be normal; the size distribution $D_c$ as a function of $\delta$ depends of course on the ductility of the rock but it is assumed that there is no size effect and that only the distribution $D_c/\delta$ is to be characterized.

It may be seen that:

The detachment threshold is all the higher as the thickness $\delta$ is smaller

Splitting up into a great number of chips (ductile rock with low $\mu$) promotes the detachment and therefore the removal possibilities The increase in the flow rate (through the velocity $\upsilon_n$ at the nozzle outlet) and the viscosity of course stimulates removal.

The mass balance is expressed as follows:

Suppose for a moment that there is no wide grain-size range. We have then:

$$\begin{aligned} dV_R/dt &= 0 && \text{if } F_L < \omega_c \\ &= N_c \cdot V_f/\tau_D && \text{if } F_L \geqq \omega_c \end{aligned}$$

where $\tau = \tau_D$ since the acceleration of the chip mainly occurs under the effect of the drag stresses. $V_f$ is the elementary volume of the chip and $N_c$ the number of production sites, i.e. the number of cutters. $V_R$, homogeneous to one volume per unit of time, is the solid removal rate.

The solid production rate (volume per unit of time) must be assumed equal to:

$$\frac{\pi}{4} D_B^2 N\delta$$

which gives a progression balance, expressed here in unit of length per unit of time:

$$\dot{s} = N\delta - \frac{\dot{V}_R}{\frac{\pi}{4} D_B^2}$$

If this balance is positive, there is an accumulation of cuttings and enrichment of the suspension. If the balance is negative, the conclusions are reversed in the presence of a bottom enriched with solid material; if it is not, removal is perfect and there is no reason to pose the present problem.

In the present model, we use a grain size distributed according to the normal law. More precisely, $D_c/\delta$ is assumed to be distributed according to a normal law of average $\mu$ and of standard deviation $\sigma$. The result is a lowering factor $\chi$ (calculated in Appendix 2) multiplier of $N_c V_f/\tau_D$ depending, as mentioned above, on the gap between $D_c^o$, the chip size achieving exactly equilibrium, and the distribution. Hence:

$$\dot{V}_R = \chi N_c \frac{\frac{\omega_o^o}{\rho_c g}}{\tau_D}$$

$\omega_o^o$ is the weight of the chip whose size is $D_c^o$ (for the thickness $\delta$).

The calculation progression is presented in Appendix 1. It allows to evaluate successively, for the chip of common size $D_c$:

the lift effect $F_L$ the drag stress $F_D$ and the associated characteristic time $\tau_D$.

The balance is then written in the form:

$$\dot{s}^+ = N\delta$$

$$\dot{s}^- = m_o\chi(\delta)$$

where $m_o$ is defined hereafter.

The removal term depends on $\delta$ only through the agency of $\chi$ and it is conditioned, in a fixed technology, by:

the velocity $\upsilon_n$ the mud viscosity the retention pressure essentially the specific gravity of the mud, secondarily the specific gravity of the chips.

In order to avoid the $$\frac{ds}{dt} = \dot{s}$$

type derived notation, we denote by $B(\delta)$ the balance, homogeneous to an accumulation (length) per unit of time.

In fact, two modifications are achieved hereafter:

(i) the first one is a purely formal modification consisting, for homogeneity reasons, in making $\delta$ dimensionless by replacing it by $y_1=\delta/\delta_o$.

The dimensionless balance, homogeneous to the inverse of a time, is denoted B so that:

$$B(y_1)=Ny_1-m_1\chi(y_1)$$

(ii) the second is achieved to account quite correctly for the balling phenomenon notably. It consists in recognizing the dependence of the expulsion term on the state variables l and h. It seemed quite convenient to us, in the first place, to account for the phenomenon by making the expulsion term only dependent on the dimensionless variable $Y_3=l/\delta_o$, so that:

$$B(y_1,Y_3)=Ny_1-m_1(y_3)\chi(y_1)$$

where the dependence $m_1(y_3)$ is formulated in Appendix 3.

Strictly speaking, the expulsion term also visibly depends on the present residual thickness of the fluid strip, i.e. h, that is rather considered as a parameter in Appendix 3.

In fact, the solid material balance comprises a production term $B^+$ corresponding to the rate of destruction of the rock and an expulsion term $B^-$. As for the dependence on the state variables $Y_1$, $Y_2$, $Y_3$, the following choice has been made:

$B^+(t)=B^+(y_1)$ destroyed rock $B^-(t)=B^-(y_1,y_3)$ expelled rock $B(t)=B^+(t)-B^-(t)$ $y_1(t)=\delta(t)/\delta_o$ limited cut in the virgin rock $y_2(t)=\text{Log } h(t)/h_o$ equivalent viscosity of the suspension $y_3(t)=l(t)/\delta_o$ limited thickness of the bed of cuttings $$B^-(y_1,y_3)=m_o f_v(y_3)\chi_{\mu/\sigma}(y_1)=m_o f^*_v(Z)\chi^*_{\mu/\sigma}(x)$$

$m_o$ removal "gauge", norm of the expulsion term $\chi^*_{\mu/\sigma}(x)$ dependence, called main dependence, on the penetration ($y_1$); stemming from the probability distribution function of the normal law $f^*_v(z)$ expulsion modulation according to the thickness of the bed of cuttings ($y_3$)

$$m_o = \frac{a_d}{a_c}\ \frac{4}{\pi}\ a_1^4 \frac{N_c}{m_8}\left(\frac{d}{D_B}\right)^9 \frac{\rho_m^5}{\rho_c}\left(\frac{d\upsilon_n}{\upsilon_o}\right)^{-\frac{9}{4}} \frac{\upsilon_n^9}{(\lambda P)^4}$$

$a_d$, $a_c$, $a_1$ coefficients used in the hydrodynamic formulation and whose values can be found in Eronini's article d nozzle diameter; $v_n$ fluid velocity at the nozzle outlet $D_B$ bit diameter $\rho_m$, $\rho_c$ mud and rock density respectively $\lambda P$ retention effect by differential pressure through the chip x and z are variables associated respectively with $y_1$ and $y_3$, allowing an explicit writing (Appendices 2 and 3).

Prior to reduction to three state variables, the problem comprises a priori five variables, three of which are geometric type variables: $\delta$, l, h, respectively depth of cut in the virgin rock, thickness of the bed of cuttings and thickness of the fluid strip. ($\gamma$ worn blade height is a slow-evolution variable in comparison with those which are studied in this problem; it therefore serves here as a parameter); then two suspension concentration type state variables; c the concentration, $\upsilon$ the associated "equivalent" dynamic viscosity (to be distinguished from the viscosity $\upsilon_o$ of the drilling fluid proper).

The evolution equations result from writing:

an equation of conservation of the sum of the thicknesses of the various sections which, expressed in differential form on the dimensional variables $\delta$, l, h, is expressed as follows:

$$d\delta+dl+dh=0$$

distribution writing of the material balance $B(y_1, y_3)$ or accumulation rate ds/dt between partial contributions due to:

(i) thickening of the bed of cuttings (dl)

(ii) increase in the suspension concentration (h dc)

(iii) decrease in the thickness of the fluid strip (c dh)

so that:

$$dl+cdh+hdc=ds$$

the control law $W=cte=W_S+W_H$.

The expression of $W_S$ and $W_H$ mentioned above allows to formulate, still in differential form, this very particular control quantity. The following condensed notation is used:

$$W_{S,\delta}=\frac{dW_S}{d\delta}=S_cN_c(\sin\alpha+\mu^+\cos\alpha)\frac{dA_c}{d\delta}$$

and this quantity is assumed to be invariant with δ. The differential relation is therefore written in the form:

$$dW=0 \text{ i.e.: } \frac{d\delta}{\delta}+\frac{d\eta}{\eta}-3\frac{dh}{h}+\frac{W_{S,\delta}}{W_H}d\delta=0$$

simplified behaviour relations:

Two differential relations are expressed hereafter, dependent on parameters a and b only, relating suspension concentration c, equivalent viscosity η and fluid strip thickness h. These relations are:

$$\eta\ dh+ah\ d\eta=0$$

$$\eta\ dc-b(1-c)d\eta=0$$

Writing of the evolution equations:

Let:

$$K=\frac{\frac{1}{\delta}+\frac{W_{S,\delta}}{W_H}}{1+3a}$$

This factor will be denoted $K(y_1,y_2)$ in the final presentation. The manipulation of the five relations leads to the reduction as follows:

$$-ds=d\delta\{1+(a+b)(1-c)hK\}$$

The five state variables thus evolve according to the very elementary pattern as follows, where X denotes, by way of simplification, the state vector and μ the control quantity:

$$\dot{\delta}=f(X,u)$$

$$\dot{l}=-(1+ahK)f(X,u)$$

$$\frac{\dot{\eta}}{\eta}=-Kf(X,u)$$

$$\frac{\dot{h}}{h}=aKf(X,u)$$

$$\frac{\dot{c}}{1-c}=-bKf(X,u)$$

with:

$$f(X,u)=\frac{-\dot{s}(X,u)}{1+h(1-c)(a+b)K}$$

We formulate on the one hand the similarity of the last three relations and use the dimensionless forms:

$$\Delta=\frac{\delta}{\delta_o}\quad \Delta=y_1$$

$$E=\log\frac{\eta}{\eta_o}\quad E=y_2$$

$$L=\frac{1}{\delta_o}\quad L=y_3$$

$$H=-\mathrm{Log}\frac{h}{h_o}$$

$$F=\mathrm{Log}(1-c)$$

The differential equations thus take on the reduced form with only three independent variables since we obviously have:

$$H(t)=aE(t)$$

$$F(t)=bE(t).$$

The evolution equations then exhibit the very particular form as follows:

$$\dot{y}_1=F_1(y_1,y_2,y_3)$$

$$\dot{y}_2=-K(y_1,y_2)F_1(y_1,y_2,y_3)$$

$$\dot{y}_3=-(1+afe^{ay_2}K(y_1,y_2,))F_1(y_1,y_2,y_3)$$

where:

$$F_1(y_1,y_2,y_3)=\frac{-B(y_1,y_3)}{1+(a+b)\frac{h_o}{\delta_o}e^{-(a+b)y_2}K(y_1,y_2)}$$

with:

$$K(y_1,y_2)=\frac{1+\frac{W_{S,\delta}e^{-(1+3a)y_2}}{W_He^{y_2}/\delta_o}}{(1+3a)y_2}$$

$K(y_1,y_2)$ characterizes the ability, in view of balance B, to channel the deposits on the bed of cuttings; K is an explicit form of the parameters.

Figure 2:
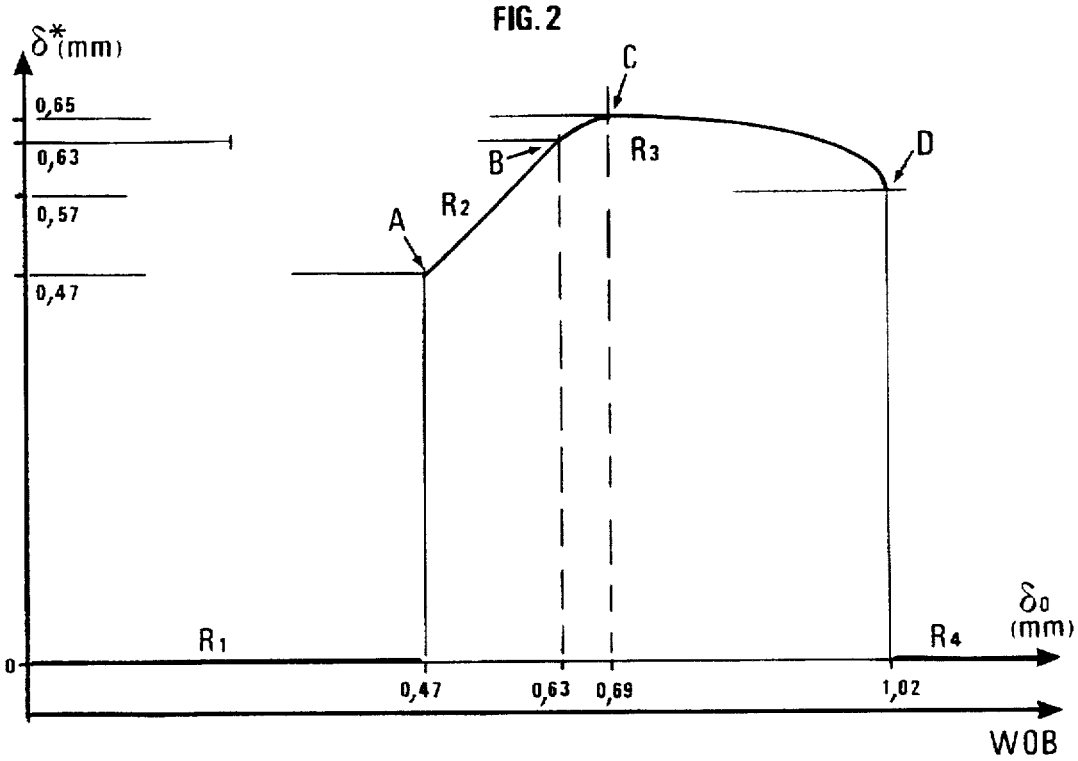
FIG. 2 shows the equilibrium curve obtained with a particular application of the model according to the invention.

A coherent example of values that have allowed to solve the case shown in FIG. 2 is given by way of illustration hereafter.

Simulations consisted in varying the input $\delta_o$, initial depth of cut in the absence of a bed of cuttings (representative of the weight on bit under ideal removal conditions). The result of the calculation is δ*, cut at equilibrium—once the transitional period has passed—which conditions the stabilized rate of penetration. The penetration efficiency can become zero after a certain weight threshold depending on the parameters of the problem (which corresponds to the balling threshold). The drilling efficiency degree can be appreciated by comparing the "solid" and "hydraulic" lift effects.

The form of the evolution equations, very particular here, leads to a monotonic convergence of δ to its equilibrium value δ* whereas fluctuations are intuitively expected (see comments in Appendix 4).

The list hereunder thus relates to the model inputs necessary to identify the case. In order to facilitate the reading thereof, these inputs have been classified.

Control parameters $\delta_o$ initial penetration in the virgin rock (link with the weight on bit WOB) (varied in the 0–1.26 mm range)

N rotary speed, assumed to be invariable (N=0.7 rps).

$\upsilon_n$ velocity of the fluid jet at the nozzle outlet (link with the mud flow rate $Q(\upsilon_n=50\ ms^{-1})$)

Parameters linked with the bit $D_B$ bit diameter ($D_B$=0.2 m)

d nozzle diameter (d=0.01 m)

$N_c$ number of cutters; as many chip producing "sites" as supports for taking up the vertical stress ($N_c$=81)

Parameter linked with the cutter

H effective cutter height (H=2.65 mm)

The parameter conditions the initial distribution $H=\delta_o+h_o$

Parameters linked with the cutter/rock interface $A\gamma$ characteristic area for the representation of the vertical stress (depending on the wear $\gamma$) ($A\gamma$=1 $mm^2$)

$A_{c,\delta}$term proportional to the penetration a representative of the cutting force ($A_{c,\delta}$=5 mm, i.e. 5 $mm^2$ of area variation per mm of penetration)

$\alpha$ and $\mu^+$ characteristic cutting angle; friction coefficient $\sin\alpha+\mu^+\cos\alpha=1$ has been selected $S_c$ "cutting" resistance (shear) ($S_c$=500 MPa)

$S_p$ "thrust load" resistance (compression) ($S_p$=500 MPa)

Parameters linked with the rock chip $\rho_c$ chip density ($\rho_c$=2500 $kg.m^{-3}$)

Parameters linked with the cutting operation $\mu$ mean slenderness ratio of the chips illustrating the degree of brittleness of the chip $\mu$ high, brittle fracture; $\mu$ low, ductile fracture ($\mu$=2) $\sigma$ grain-size distribution narrowing (standard deviation) ($\sigma$=0.5)

Parameters linked with the expulsion $\mu$ coefficient serving for the definition of the hydraulic diameter $\upsilon 0<\upsilon<1$ balling sensitivity index ($\upsilon$=1 no sensitivity)

Parameter linked with the mud/sound rock interface $\lambda P$ chip holding effect ($\lambda P$=1 MPa)

Parameters linked with the mud $\rho_m$mud weight ($\rho_m$=1250 $kg.m^{-3}$)

$\upsilon_o$ kinematic viscosity of the mud; to be distinguished from the "equivalent viscosity" characterizing the suspension, notably for the hydraulic lift effect $$\upsilon_o=10^{-3}\ m^2s^{-1}\ \text{(dynamic viscosity } \eta=1.25\ \text{Pa.s)}$$

Constitutive parameters linking certain evolution parameters at the level of the interface laws a for the link between equivalent viscosity and fluid strip thickness (a=1)

b for the link between equivalent viscosity and suspension concentration (b=1)

The curve shown in FIG. 2 is thus the expression of the drill bit behaviour in terms of efficiency for this particular selection of 23 parameters. The curve shown in FIG. 2 is the response of the drill bit, at equilibrium, to the control data: weight on bit. More precisely, in terms of evolution model:

the initial penetration is laid off as abscissa the penetration at equilibrium is laid off as ordinate.

The division into four characteristic working conditions can be noted.

Working condition 1 (R1): below a certain weight threshold, corresponding to an initial penetration threshold, the state slowly evolves towards complete clogging through the production of free cuttings; the expulsion capacity is saturated by excess broken rock production conditions.

Working condition 2 (R2): the possibilities of removal of the cuttings by the hydraulics predominate here, so that, under such conditions, only the usual technical characteristics linking the weight on bit (WOB) and the rate of penetration (ROP) come into play to limit the performances in terms of rate of penetration. The instances representative of working condition 2 are of course characterized by $\delta_o=\delta^*$, since the bed of cuttings cannot re-form on a long-term basis.

Working condition 3 (R3): it is here again (as in working conditions 1 and 4) an instance where the removal capacity is less than the production of broken rock at any time of the evolution. However, by displacement of the initial state, the system reaches a configuration where the mass balance is balanced.

The removal conditions become progressively increasingly unfavourable in relation to the rock production conditions, with the increase in the weight on bit (equivalent to the increase of $\delta_o$). This weight is increasingly taken up in the form of hydraulic lift $W_H$ due to gradually more difficult conditions of expulsion of the particle-enriched drilling fluid (increasing pressure drops) to the detriment of the solid vertical stress W assigned to the effective power of breaking the virgin rock.

Working condition 4 (R4): below a certain weight threshold, the method of operation of the system comprises a fast evolution towards clogging through the production of initially coarse, then gradually increasingly finer cuttings.

By way of example, in order to complete the illustration of the instance presented in FIG. 2, the vertical stress corresponding to a penetration of $\delta_o$=0.63 mm of each of the cutters (point B), considering the characteristics of the rock, is 165 kN; for a penetration $\delta_o$=0.69 mm (point D), the associated weight on bit is 190 kN, the hydraulic contribution $W_H$ to equilibrium gets significant, of the order of 5 kN.

The balling threshold $\delta_o^{THRESHOLD}$=1.02 mm (in the present instance) (point C) corresponds to the condition of application of the weight on bit WOB=245 kN, which leads irremediably within a few seconds to a complete clogging of the space contained between the bit body and the formation: the rock production/rock expulsion mass balance has become so unfavourable that there is no possibility of "dynamic equilibrium" (with $\delta^*$, non-zero penetration).

It is clear that the determination of value $\delta_o$ at point (D) in FIG. 2 gives the optimum working point for the given parametric conditions. In fact, the bell-shaped curve vertex represents the highest rate of penetration, and therefore the highest drill bit efficiency.

APPENDIX 1

EXPRESSION OF THE HYDRODYNAMIC STRESSES EXERTED ON THE CHIP AND TIME CONSTANTS ASSOCIATED WITH THE CORRESPONDING MECHANISMS

Lift stress : evaluation of the threshold characteristic size $D_c^o$

Eronini's basic formula expresses semi-empirically the lift stress exerted on a particle of hydraulic diameter $D_c$ in the neighbourhood of a bit of diameter $D_B$ when the fluid velocity is $\upsilon_n$ at the outlet of a nozzle of diameter d.

$$F_L = a_L \rho_m \left(\frac{D_c}{D_B}\right)^2 d^2 v_n^2 \left(\frac{D_c}{D_B}\frac{dv_n}{\upsilon_o}\right)^{-\frac{1}{2}}$$

$\rho_m$ is the mud weight, $\upsilon_o$ its viscosity and $a_L$ a proportionality constant.

The chip of size $D_c$ has an own weight :

$$\omega_o = m^2 D_c^2 \delta \rho_c g$$

hence :

$$\frac{F_L}{\omega_o} = \frac{a_L}{gm^2}\frac{\rho_m}{\rho_c}\frac{1}{D_c^{1/2} D_B^{3/2}\delta} d^2 v_n^2 \left(\frac{dv_n}{\upsilon_o}\right)^{-\frac{1}{2}}$$

The number n of chips detached by each of the $N_c$ blades during one revolution will be preferably introduced, rather than the variable $D_c$ :

$$n = \frac{\pi}{4m^2 N_c}\left(\frac{D_B}{D_c}\right)^2$$

The expression above is then modified to :

$$\frac{F_L}{\omega_o} = \frac{a_L}{\left(\frac{\pi}{4}\right)^{1/4}} \frac{d^2 v_n^2}{g D_B^2} \frac{\rho_m}{\rho_c} \frac{N_c^{1/4} n^{1/4}}{m^{3/2}} \frac{1}{\delta} \left(\frac{d v_n}{\upsilon_o}\right)^{-\frac{1}{2}}$$

Let us now pay attention to the threshold quantities, characteristic size $D_c^o$ of the chips in number $n_o$, at the detachment threshold, i.e. with :

$$\frac{F_L}{\omega_o} = 1 + \frac{\lambda P}{\delta \rho_c g} \approx \frac{\lambda P}{\delta \rho_c g}$$

We have :

$$\frac{N_c^{1/4} n_o^{1/4}}{m^{3/2}} = \frac{(\pi/4)^{1/4}}{a_L} \frac{g D_B^2}{d^2 v_n^2} \frac{\rho_c}{\rho_m} \frac{\lambda P}{\rho_c g} \left(\frac{d v_n}{\upsilon_o}\right)^{\frac{1}{2}}$$

We show, after some calculations, that :

$$\frac{D_c^o}{D_B} = \frac{a_L^2}{m^4} \left(\frac{d v_n}{D_B}\right)^4 \left(\frac{d v_n}{\upsilon_o}\right)^{-1} \left(\frac{m}{\lambda P}\right)^2$$

The greater the threshold size $D_c^o$ under which the chip is detached, the higher the potential solid discharge.

Drag stress : estimation of the characteristic expulsion time and of the removal term

The drag effect $F_D$ is evaluated by Eronini according to a formula analogous to that describing the lift effect.

28

The associated characteristic time is such that :

$$\frac{1}{\tau_D} = \frac{\frac{F_D}{\omega_o}}{\frac{v_c}{g}} \qquad \text{where } v_c = \left(\frac{a_c d}{D_B}\right) v_n$$

is an estimate of the mean circulation rate of the fluid at the bit edge given by Eronini.

Hence :

$$\frac{1}{\tau_D} = \frac{1}{\frac{v_c}{g}} a_D \frac{d^2 v_n^2}{g D_B^2} \frac{\rho_m}{\rho_c} \frac{1}{m^2} \frac{1}{\delta} \left(\frac{d v_n}{\upsilon_o}\right)^{-\frac{1}{4}}$$

This characteristic time is independent of the particle size $D_c$.

The solid balance is finally written as follows, by formulating the definition of the expulsion term :

$$\dot{V}_R = \chi N_c \frac{\frac{\omega_o^o}{\rho_c g}}{\tau_D}$$

$$\dot{s} = N\delta - \frac{\dot{V}_r}{\frac{\pi}{4} D_B^2} = N\delta - \chi \frac{a_D}{a_c} \frac{4}{\pi} a_L^4 \frac{N_c}{m^8} \left(\frac{d}{D_B}\right)^9 \frac{\rho_m^5}{\rho_c} \left(\frac{d v_n}{\upsilon_o}\right)^{-\frac{9}{4}} \frac{v_n^9}{(\lambda P)^4}$$

APPENDIX 2

CALCULATION OF THE LOWERING FACTOR $\chi$

Preliminary remark

Let $F_{\mu,\sigma}$ be the function of the normal law of average $\mu$ and of standard deviation $\sigma$; it is incorrect to write :

$$\chi = F_{\mu,\sigma}\left(\frac{D_c^o}{\delta}\right)$$

This writing would imply a distribution in relative number of chips whereas we are seeking a weighting in volume :

$\mu$ : average grain-size distribution imposed by the cutting type $\mu = \frac{E(D_c)}{\delta}$ $\delta$ : present cutting thickness $D_c^o$ : threshold size for the hydraulics (independent of $\delta$).

Calculation of $\chi$

The ratio of the volume corresponding to chips of distributed size $D_c$ to the volume of material detached if the grain-size distribution were assimilable to a Dirac distribution on $D_c^o$ has to be calculated, the elementary volume of the chips being then :

$$\frac{\omega_o^o}{\rho_c g}$$

30

The elementary volume of the chip of hydrodynamic size $D_c$ is :

$$\frac{\omega_o^o}{\rho_c g}\left(\frac{D_c}{D_c^o}\right)^2 m^2$$

so that, for a wide grain-size range of average $\mu$ and of standard deviation $\sigma$ :

$$\dot{V}_R = N_c \frac{\frac{\omega_o^o}{\rho_c g}}{\tau_D}\int_{-\infty}^{\frac{D_c^o}{\delta}} \frac{1}{\sigma\sqrt{2\pi}} e^{-\frac{(t-\mu)^2}{2\sigma^2}} t^2 dt \frac{\delta^2}{(D_c^o)^2}$$

with :

$$t = \frac{D_c}{D_c^o}\frac{D_c^o}{\delta} = \frac{D_c}{\delta}$$

(It would have been more attractive to adopt a normal log law so as not to have to consider the negative t).

Hence :

$$\chi = \left(\frac{\delta}{D_c^o}\right)^2 \int_{-\infty}^{\frac{D_c^o}{\delta}} \frac{1}{\sigma\sqrt{2\pi}} e^{-\frac{(t-\mu)^2}{2\sigma^2}} t^2 dt$$

An integration by parts gives, after some calculations :

$$\chi(\delta) = \tilde{\chi}_{\frac{\mu}{\sigma}}\left(\frac{\frac{D_c^o}{\delta} - \mu}{\sigma}\right)$$

with :

$$\tilde{\chi}_{\frac{\mu}{\sigma}}(x) = \frac{1}{\left(x + \frac{\mu}{\sigma}\right)^2}\left[\left(1 + \left(\frac{\mu}{\sigma}\right)^2\right)\phi(x) - \frac{1}{\sqrt{2\pi}}\left(x + 2\frac{\mu}{\sigma}\right)e^{-\frac{x^2}{2}}\right]$$

$\phi(x)$ probability distribution function of the reduced centred normal law.

31

$\tilde{\chi}_{\frac{\mu}{\sigma}}(x)$ only depends on the ratio of the mean value to the standard deviation of the size distribution $\mu$ is linked with the rock ductility $\sigma$ is linked with the grain-size range narrowing.

($\mu$ is a dimensionless variable expressing in a way the average brittleness of the rock in the form of a "slenderness ratio" of the fragment; a link can also be established between this characteristic and the angle of friction of a material).

$$\mu = \frac{E(D_c)}{\delta}$$

$\frac{D_c^o}{\delta}$ is the threshold, taking account mainly of the pressure conditions, above which the particles need not be included in the removal balance.

Remarks

- If the conditions (mud viscosity $\upsilon_o$ and weight $\rho_m$, differential pressure P) do not evolve, the threshold $D_c^o$ is invariant.

- Furthermore, if the characteristics $\mu$ and $\sigma$ of the rock do not change, curve $\chi(\delta)$ is invariant.

APPENDIX 3

MODULATING FUNCTION ACCORDING TO THE THICKNESS OF THE BED OF CUTTINGS

It seemed necessary to modulate the expulsion term according to the variable thickness of the bed of cuttings so as to take account of the following mechanisms, referred to as A and B; mechanism A predominates when the fluid strip h is wide and mechanism B prevails when this strip becomes narrow.

- mechanism A is characterized by a decrease in the chip retention effect in the presence of a bed of cuttings that notably establishes the increase in performances at equilibrium in terms of rate of penetration ROP when the weight on bit WOB is increased ($\delta < h$)

- mechanism B corresponds to a difficult expulsion of the chip due to the narrowness of the fluid strip (h) in relation to the chip size ($\delta$) ($\delta > h$)

- the transition ($\delta \approx h$) corresponds to a competition of mechanisms A and B.

The removal balance is written in the form as follows :

$$B^{-}(y_1, y_3) = m_o f_v(y_3) \chi_{\mu/\sigma}(y_1)$$

where v is an index referred to as balling sensitivity index serving as a parameter in the function $f_v$ selected :

$$f_v^*(z) = \left(1 + \frac{z}{v}\right) e^{-z}$$

$$f_v^*(z) = f_v(y_3) \quad \text{with} \quad \frac{1-v}{\frac{h_o}{\delta_o} - 1} y_3 = z$$

where $h_o$ and $\delta_o$ are the parameters associated with the initial values of variables h and $\delta$.

APPENDIX 4

LINEARIZATION IN THE NEIGHBOURHOOD OF EQUILIBRIUM

SUMMARY AND NOTATIONS

A system whose state variables are defined by the vector x and the main parameters gathered in the vector $\lambda$ is described by evolution equations of the form as follows :

$$\dot{X} = F(X, \lambda)$$

It is often examined in the neighbourhood of a position of equilibrium $X_o$, thus meeting :

$$F(X_o, \lambda) = 0$$

The local coordinates $\xi$ are introduced about $X_o$ so that :

$$X = X_o + \xi$$

and the initial differential system then takes on a so-called linearized form [disregarding the residual term $(\xi,\lambda)$].

34

$$\dot{\xi} = A(\lambda)\xi + f(\xi,\lambda)$$

where $$A(\lambda) = \left.\frac{\partial F_i}{\partial X_j}\right|_{X=X_o}$$

and $f(\xi,\lambda) = 0(|\xi|^2)$ contains terms of degree greater than or equal to 2.

It ensues from Liapunov's stability theorems that :

(i) $X_o$ is stable if the eigenvalues of $A(\lambda)$ have negative real parts (ii) X is unstable if at least one eigenvalue has a positive real part (iii) a critical case is when the real part of one or more eigenvalues is zero whereas the other eigenvalues keep their negative real part.

Application : writing of the Jacobian $A(\lambda) = \left.\frac{\partial F_i}{\partial X_j}\right|_{X=X_o}$ The differential system then takes on the quite particular form as follows :

$$\dot{y}_1 = F_1(y_1,y_2,y_3)$$
$$\dot{y}_2 = -K(y_1,y_2)F_1(y_1,y_2,y_3)$$
$$\dot{y}_3 = -\left[1 + a\frac{h_o}{\delta_o}K(y_1,y_2)e^{-ay_2}\right]F_1(y_1,y_2,y_3)$$

with :

$$F_1(y_1,y_2,y_3) = \frac{-B(y_1,y_3)}{1+(a+b)\frac{h_o}{\delta_o}K(y_1,y_2)e^{-(a+b)y_2}}$$

At equilibrium :

$$B(y_1,y_3) = \Leftrightarrow F_1(y_1,y_2,y_3) = 0$$

35

The Jacobian is written in the form :

$$A(\lambda)=\begin{bmatrix} \frac{\partial F_l}{\partial y_1} & \frac{\partial F_l}{\partial y_2} & \frac{\partial F_l}{\partial y_3} \\ -\frac{\partial K}{\partial y_1}F_l-K\frac{\partial F_l}{\partial y_1} & -\frac{\partial K}{\partial y_2}F_l-K\frac{\partial F_l}{\partial y_3} & -K\frac{\partial F_l}{\partial y_3} \\ a_{31} & a_{32} & a_{33} \end{bmatrix}$$

Taking account of the relations expressing equilibrium, the Jacobian matrix is written in the simplified form as follows :

$$\left(\text{with } \frac{F_l}{B}=\frac{-1}{1+(a+b)\frac{h_o}{\delta_o}Ke^{-(a+b)y_2}}\right)$$

$$\begin{cases} a_{11}=\frac{F_l}{B}\frac{\partial B}{\partial y_1} \\ a_{12}=0 \\ a_{13}=\frac{F_l}{B}\frac{\partial B}{\partial y_3} \end{cases}$$

$$a_{21}=-Ka_{11}$$

$$a_{22}=0$$

$$a_{23}=-Ka_{13}$$

$$\begin{cases} a_{31}=-\left(1+a\frac{h_o}{\delta_o}Ke^{-ay_2}\right)a_{11} \\ a_{32}=0 \\ a_{33}=-\left(1+a\frac{h_o}{\delta_o}Ke^{-ay_2}\right)a_{13} \end{cases}$$

This is written, in the neighbourhood of equilibrium, in the forms :

$$\dot{\xi}_{y_1} = \frac{F_1}{B}\left(\frac{\partial B}{\partial y_1}\xi_{y_1} + \frac{\partial B}{\partial y_3}\xi_{y_3}\right) + 0\left(|\xi|^2\right)$$

$$\dot{\xi}_{y_2} = -K\dot{\xi}_{y_1} + 0\left(|\xi|^2\right)$$

$$\xi_{y_3} = -\left(1 + a\frac{h_o}{\delta_o}Ke^{ay_2}\right)\dot{\xi}_{y_1} + 0\left(|\xi|^2\right)$$

$$\text{let } L^* = 1 + a\frac{h_o}{\delta_o}K^* e^{-ay_3}$$

where the symbols * remind that the calculation must be carried out for a triplet $(y_1,y_2,y_3)$ meeting the equilibrium condition.

Then :

$$\dot{\xi}_{y_1} = \frac{F_1}{B}\xi_{y_1}\left(\frac{\partial B}{\partial y_1} - L^*\frac{\partial B}{\partial y_3}\right)$$

describes the linearized behaviour in the neighbourhood of equilibrium, the course is of the exponential type (converging) if :

$$\frac{F_1}{B}\left(\frac{\partial B}{\partial y_1} - L^*\frac{\partial B}{\partial y_3}\right) < 0$$

The condition :

$$\frac{\partial B}{\partial y_1} - L^*\frac{\partial B}{\partial y_3} = 0$$

defines, together with $B(y_1,y_3) = 0$, the bifurcation condition characterizing the balling.

The complete and explicit solution of the bifurcation relations can be carried out if one takes advantage of the fact that, when the transition to balling occurs, $K(y_1,y_2)$ is close to 1.

It can then be shown that, in variables x and z (see Appendices 2 and 3), the bifurcation condition takes on the explicit form z function of x :

Equilibrium condition : (B = 0)

$$\left(1+\frac{z}{\upsilon}\right)e^{-z}\chi^{*}_{\frac{\mu}{\sigma}}(x)=\frac{N}{m_o}\frac{k\frac{\mu}{\sigma}}{x+\frac{\mu}{\sigma}}$$

Bifurcation condition : (dB = 0)

$$\left(x+\frac{\mu}{\sigma}\right)\frac{\frac{e^{-\frac{x^2}{2}}}{\sqrt{2\pi}}}{\chi^{*}_{\frac{\mu}{\sigma}}(x)}=1+\left(1-\frac{1}{\upsilon+z}\right)\frac{1-\upsilon}{\frac{h_o}{\delta_o}-1}\cdot\frac{k\frac{\mu}{\sigma}}{x+\frac{\mu}{\sigma}}$$

$$\text{with } k=\frac{1}{\mu}\frac{D_c^o}{\delta_o}$$

It can be noted that the bifurcation condition is independent of N.

REMARK

In a less particular instance where notably the supposed proportionality of the quantities $E=\mathrm{Log}\frac{\eta}{\eta_o}=y_2, H=-\mathrm{Log}\frac{h}{h_o}, F=-\mathrm{Log}(1-x)$ implies a one-dimensional linearized behaviour, we would have :

$$\dot{\xi} = A\xi \qquad \xi = (\xi_1, \xi_2, \xi_3)$$

$\chi(s)$=determinant(sI-A)

with 3 complex or real eigenvalues and an convergence to equilibrium of a different type than that supposed here.

I claim:

1. A method for improving drilling performance where a drilling model is used, comprising determining the effects of the destruction of a rock (2) by at least one cutter (1) fastened to a bit body (3) driven in rotation and the effects of removal of the rock cuttings by a fluid, by calculating a material balance from:

the production of rock cuttings by the cutter that has penetrated the rock by a depth of $\delta$, a bed of cuttings covering said rock under a thickness l, a fluid strip of thickness h contained between said bed of cuttings and said body, said fluid strip having a cuttings concentration c, control parameters, and environment parameters, so as to obtain said model, and determining drilling conditions as a function of the response of said model for predetermined values of said parameters.

2. A method as claimed in claim 1, wherein at least one of said parameters: weight on bit, bit speed and fluid flow rate, is a control parameter.

3. A method as claimed in claim 1, wherein in said model, the lift W of the bit is split up into a solid component $W_S$ and a hydraulic component $W_h$ depending notably on the fluid strip.

4. A method as claimed in claim 1, wherein a wide grain-size range of the cuttings is distributed according to a normal law as a function of the depth of cut $\delta$, of average $\mu$ linked with the ductility of the rock and of a dispersion characterized by the standard deviation $\sigma$.

5. A method as claimed in claim 1, wherein said solid material balance B(t) is such that $B(t)=B^+(t)-B^-(t)$, where $B^+(t)$ is a cutting production term dependent on $\delta$ and corresponding to the rate of destruction of the rock, and $B^-(t)$ is an expulsion term dependent on l and h.

6. A method as claimed in claim 2, wherein in said model, the lift W of the bit is split up into a solid component $W_s$ and a hydraulic component $W_h$ depending notably on the fluid strip.

7. A method as claimed in claim 2, wherein a wide grain-size range of the cuttings is distributed according to a normal law as a function of the depth of cut $\delta$, of average $\mu$ linked with the ductility of the rock and of a dispersion characterized by the standard deviation $\sigma$.

8. A method as claimed in claim 3, wherein a wide grain-size range of the cuttings is distributed according to a normal law as a function of the depth of cut $\delta$, of average $\mu$ linked with the ductility of the rock and of a dispersion characterized by the standard deviation $\sigma$.

9. A method as claimed in claim 6, wherein a wide grain-size range of the cuttings is distributed according to a normal law as a function of the depth of cut $\delta$, of average $\mu$ linked with the ductility of the rock and of a dispersion characterized by the standard deviation $\sigma$.

10. A method as claimed in claim 2, wherein said solid material balance B(t) is such that $B(t)=B^+(t)-B^-(t)$, where $B^+(t)$ is a cutting production term dependent on $\delta$ and corresponding to the rate of destruction of the rock, and $B^-(t)$ is an expulsion term dependent on l and h.

11. A method as claimed in claim 3, wherein said solid material balance B(t) is such that $B(t)=B^+(t)-B^+(t)$, where $B^+(t)$ is a cutting production term dependent on $\delta$ and corresponding to the rate of destruction of the rock, and $B^-(t)$ is an expulsion term dependent on l and h.

12. A method as claimed in claim 4, wherein said solid material balance B(t) is such that $B(t)=B^+(t)-B^-(t)$, where $B^+(t)$ is a cutting production term dependent on $\delta$ and corresponding to the rate of destruction of the rock, and $B^-(t)$ is an expulsion term dependent on l and h.

13. A method as claimed in claim 6, wherein said solid material balance B(t) is such that $B(t)=B^+(t)-B^-(t)$, where $B^+(t)$ is a cutting production term dependent on $\delta$ and corresponding to the rate of destruction of the rock, and $B^-(t)$ is an expulsion term dependent on l and h.

14. A method as claimed in claim 7, wherein said solid material balance B(t) is such that $B(t)=B^+(t)-B^-(t)$, where $B^+(t)$ is a cutting production term dependent on $\delta$ and corresponding to the rate of destruction of the rock, and $B^-(t)$ is an expulsion term dependent on l and h.

15. A method as claimed in claim 8, wherein said solid material balance B(t) is such that $B(t)=B^+(t)-B^-(t)$, where $B^+(t)$ is a cutting production term dependent on $\delta$ and corresponding to the rate of destruction of the rock, and $B^-(t)$ is an expulsion term dependent on l and h.

16. A method as claimed in claim 9, wherein said solid material balance B(t) is such that $B(t)=B^+(t)-B^-(t)$, where $B^+(t)$ is a cutting production term dependent on $\delta$ and corresponding to the rate of destruction of the rock, and $B^-(t)$ is an expulsion term dependent on l and h.

* * * * *